US006124782A

United States Patent [19]

Kraft, Sr.

[11] Patent Number: 6,124,782

[45] Date of Patent: Sep. 26, 2000

[54] WIND-ACTIVATED AUDIO-GENERATING APPARATUS

[76] Inventor: Joseph D. Kraft, Sr., N8 W29947 Woodcrest Ct., Waukesha, Wis. 53188

[21] Appl. No.: 09/363,176

[22] Filed: Jul. 29, 1999

[51] Int. Cl.[7] ..... G08B 3/00

[52] U.S. Cl. ..... 340/393.2; 340/384.1; 340/392.1; 340/392.5; 340/395.5

[58] Field of Search ..... 340/393.2, 392.2, 340/392.1, 392.4, 384.1, 467, 602, 392.5; 362/86, 395.1, 392.5

[56] References Cited

U.S. PATENT DOCUMENTS

| | | | |
|---|---|---|---|
| 2,822,425 | 2/1958 | Hicks | 434/313 |
| 4,854,214 | 8/1989 | Lowe | 84/404 |
| 5,072,208 | 12/1991 | Christensen | 340/392 |
| 5,208,578 | 5/1993 | Tury et al. | 340/393 |
| 5,213,234 | 5/1993 | Stefanopoulos | 222/78 |
| 5,315,909 | 5/1994 | Hsu | 84/404 |
| 5,316,516 | 5/1994 | Saitoh | 446/175 |
| 5,346,421 | 9/1994 | Yeh | 446/199 |
| 5,473,307 | 12/1995 | Lam | 340/467 |
| 5,831,516 | 11/1998 | Jennings | 340/392.4 |
| 5,980,056 | 11/1999 | West | 362/86 |

OTHER PUBLICATIONS

Singing Bird Clock advertisement, TeleBrands.

*Primary Examiner*—Edward Lefkowitz
*Assistant Examiner*—Davetta W. Goins
*Attorney, Agent, or Firm*—Foley & Lardner

[57] ABSTRACT

A wind-activated audio-generating apparatus includes a sound-generating circuit and a wind switch having multiple contacts that are suspended from a support. When subjected to an air current, the contacts of the wind switch randomly strike one another and create a momentary electrically conductive path for an electrical signal. The electrical signal is applied to the sound-generating circuit, which is configured to generate an audio effect, such as a birdcall, in response thereto. The sound-generating circuit can also be configured to selectively generate an audio effect based on the occurrence of a predetermined condition, such as the detection of daylight.

20 Claims, 3 Drawing Sheets

FIG. 1
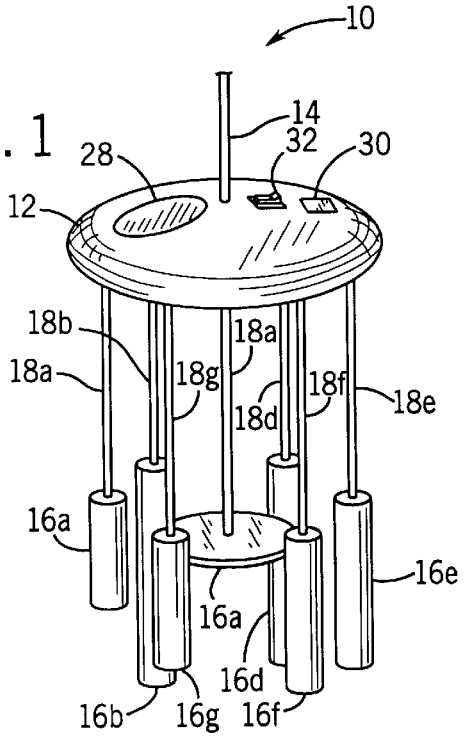
FIG. 5
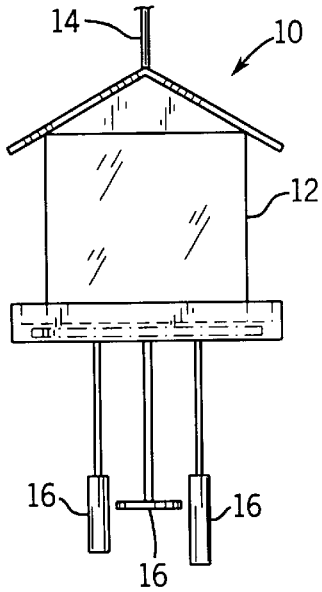
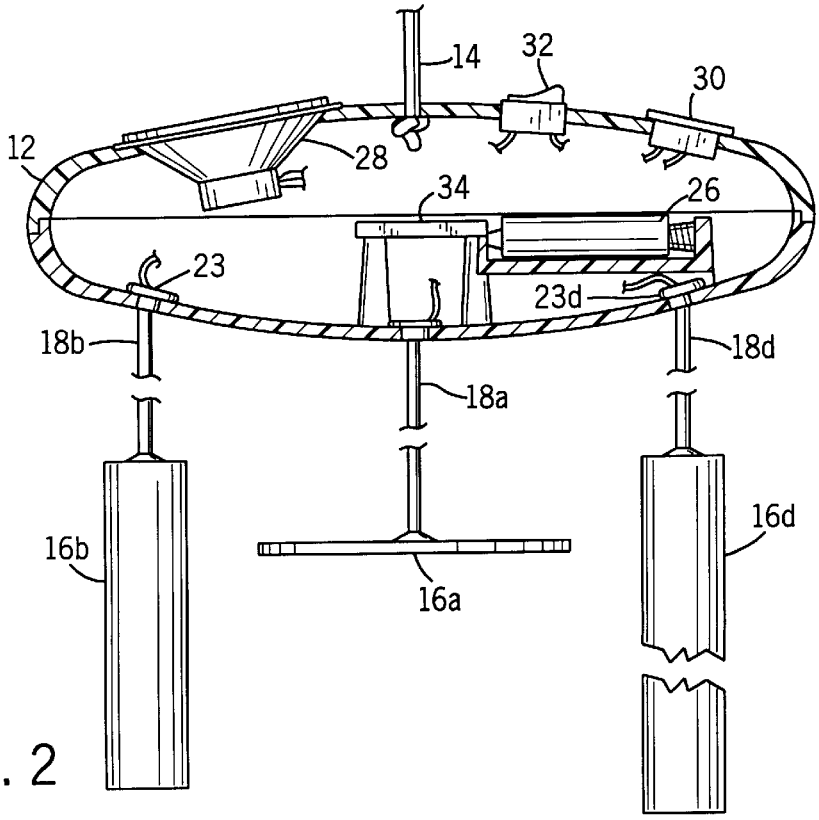
FIG. 2

WIND-ACTIVATED AUDIO-GENERATING APPARATUS

FIELD OF THE INVENTION

The present invention relates generally to a wind-activated apparatus, such as a wind chime, and more particularly to an apparatus that electronically generates an audio effect when the apparatus is placed in an air current.

BACKGROUND OF THE INVENTION

A conventional wind chime includes a plurality of chimes, such as plates of various shapes or tubes of varying lengths, which are arranged in a hanging manner such that, when moved by an air current, the chimes randomly strike one another and produce a musical chiming effect.

It would be desirable, however, to provide a wind chime assembly which produces an audio effect in addition to the musical chiming. Such an assembly could electronically produce the audio effect in response to the wind-driven contact between the chimes. The audio effect advantageously could include a variety of different types of sounds, such as different types of nature sounds (e.g., birdcalls, rain, wind, surf, etc.), musical compositions, etc., or any combination thereof. Further, it would be desirable to control generation of the audio effect based on occurrence of certain conditions. For example, the owner of the wind chime may wish to disable the audio effect during the night.

SUMMARY OF THE INVENTION

Accordingly, a wind-activated, audio-generating apparatus is provided which electronically produces an audio effect in response to contact between electrically conductive contacts suspended in such a manner that the contacts strike one another when moved by an air current.

According to one aspect of the invention, a wind-activated, audio-generating apparatus includes a support member, a wind switch, and a sound-generating circuit. The wind switch includes first and second electrically conductive contacts which are suspended from the support member such that, when the wind switch is subjected to an air current, the first and second contacts strike one another. The sound-generating circuit is in electrical communication with the first and second electrically conductive contacts and is configured such that, when the first and second contacts strike one another, an electrical path is established therebetween and the circuit generates an audio effect in response thereto.

In accordance with another aspect of the invention, a wind chime assembly is provided which includes a housing, a sound-generating circuit supported by the housing, and a plurality of chimes suspended from the housing. The chimes include a first chime and a second chime having a first conductive portion and a second conductive portion, respectively, which are arranged to contact one another when the first and second chime members are subjected to an air current. A first electrical conductor electrically couples the first conductive portion to the sound-generating circuit and a second electrical conductor electrically couples the second conductive portion to the sound-generating circuit. The sound-generating circuit is configured to generate an audio effect when the first and second conductive portions contact one another.

In accordance with yet another aspect of the invention, an audio-generating wind chime assembly includes a plurality of chime tubes and a clapper suspended from a housing such that the clapper randomly strikes the chime tubes when subjected to an air current. The clapper and at least one of the chime tubes are electrically conductive. The assembly also includes a sound-generating circuit disposed within the housing. A first electrical conductor electrically couples the electrically conductive chime tube to a first input of the sound-generating circuit, and a second electrical conductor electrically couples the clapper to a second input of the sound-generating circuit. When the clapper strikes the electrically conductive chime tube, an electrical path is established between the first and second inputs of the sound-generating circuit, which then generates an audio effect in response thereto.

BRIEF DESCRIPTION OF THE DRAWINGS

The invention will hereafter be described with reference to the accompanying drawings, wherein like reference numerals denote like elements, and:

FIG. 1 is a perspective view of a wind-activated audio-generating apparatus in accordance with the invention;

FIG. 2 is a sectional view of the apparatus of FIG. 1;

FIG. 5 is an elevational view of an alternative embodiment of the invention in which the housing is configured as a bird feeder.

DETAILED DESCRIPTION OF EMBODIMENTS OF THE INVENTION

Figure 3:
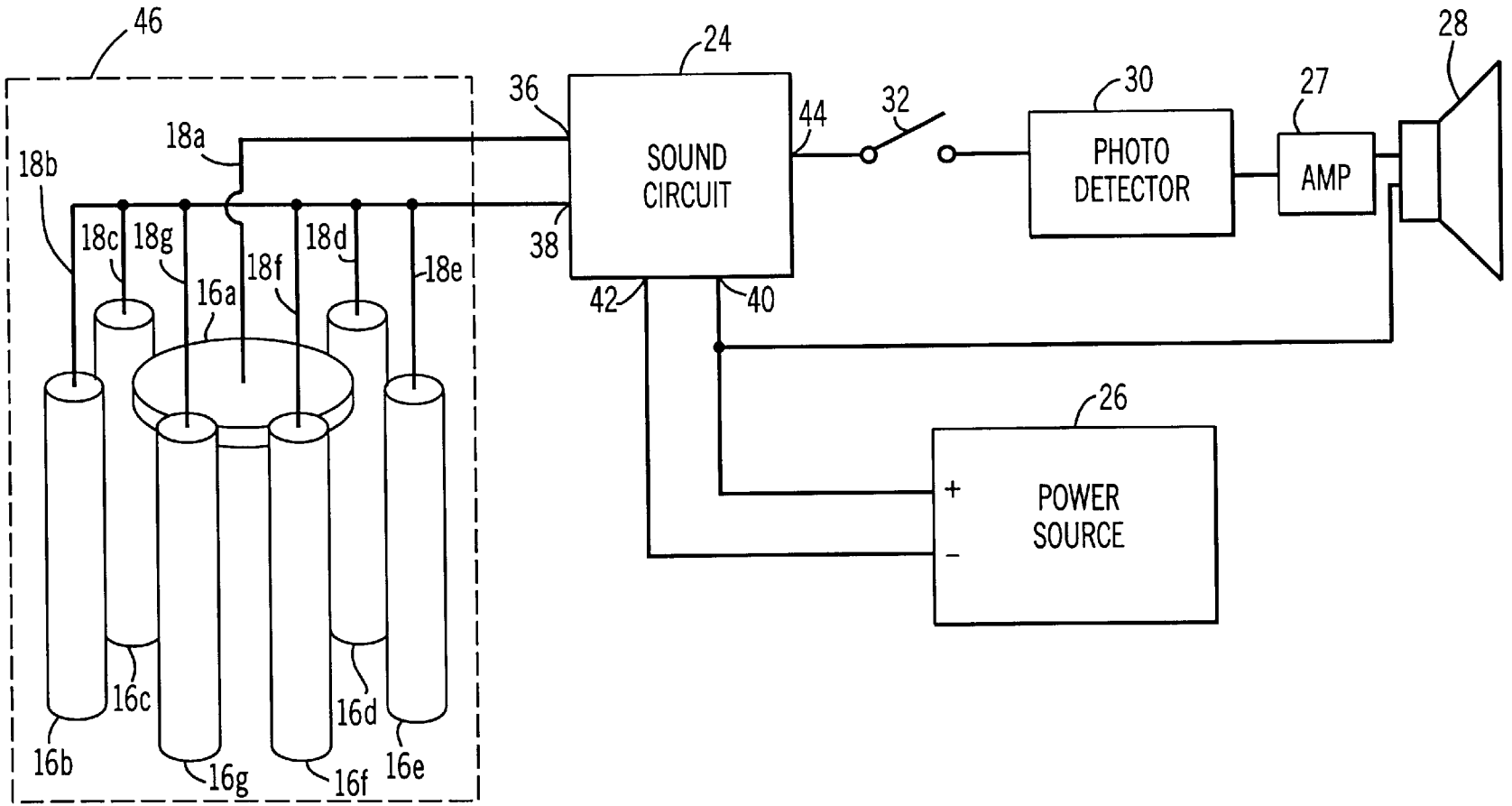
FIG. 3 is a block diagram of the apparatus of FIG. 1.

Referring now to FIG. 1, a wind-activated apparatus 10 is illustrated which electronically produces an audio effect when electrically conductive contacts suspended from a support strike one another. Apparatus 10 includes a support member 12 to which is coupled a conventional hanger 14 (e.g., a hook, an eye, a rope, etc.) to facilitate hanging apparatus 10 from a fixed attachment point, such as a roof overhang or a tree limb. Support member 12 may be made of any material, such as plastic or wood, in any configuration suitable to support a plurality of electrically conductive contacts (e.g., chimes) 16 which are suspended from support member 12. In the embodiment illustrated in FIG. 1, contacts 16 are configured as a clapper 16*a* suspended amid a plurality of chime tubes 16*b–g*. Clapper 16*a* and chime tubes 16*b–g* are made of an electrically conductive material, such as stainless steel or copper. Further, chime tubes 16*b–g* have varying lengths such that a variety of chiming tones or chords may be produced. In alternative embodiments, contacts 16 may be all chimes tubes, the chime tubes may be of all the same length, or, chimes 16 may be configured as plates of various sizes and shapes, such as a plate shaped like a bird. As yet another alternative, contacts 16 may be an electrically conductive object (e.g., a shaped plate, a ring, a knob, etc.) that is attached to or part of an otherwise non-conductive object (e.g., a ceramic chime tube, a ceramic wind plate, etc.).

Regardless of their configuration, contacts 16 are suspended from support member 12 by a plurality of suspension cords 18*a–g*. In the embodiment of the invention illustrated in FIGS. 1 and 2, all of suspension cords 18*a–g* are electrical conductors, such as insulated or non-insulated copper wires, chain links, etc. However, it should be understood that not all of cords 18*a–g* need be electrical conductors, and, in alternate embodiments of the invention, as few as two of cords 18*a–g* are electrical conductors.

Apparatus 10 may also include a conventional wind deflector (not shown) attached to suspension cord 18*a* and hanging from the underside of clapper 16*a*. Such a wind deflector is configured to be deflected by a slight air current, thus causing movement of clapper 16*a* such that it randomly contacts any of chimes 16*b–g*, thus mechanically producing chiming tones. In the embodiments of the invention illustrated in the FIGURES, a wind deflector is omitted as it is not an element necessary to cause contacts 16 to strike one another. Rather, in the FIGURES, contacts 16 are arranged in such a manner that they themselves are deflected and strike one another when placed in an air current.

Apparatus 10 also includes a sound-generating circuit 22 which is supported by support member 12. In the embodiment illustrated in FIG. 1, support member 12 is configured as an enclosed housing to which the various components of sound-generating circuit 22 are mounted or attached. In the embodiment of the invention illustrated in FIGS. 2 and 3, sound-generating circuit 22 includes inputs 23*a–g*which are coupled to contacts/chimes 16*a–g* via suspension cords 18*a–g*, respectively.

Sound-generating circuit 22 further includes a sound-control module 24, a power source 26, an amplifier 27 and a speaker 28, a photodetector 30, and an ON/OFF switch 32. Sound-control module 24 includes a printed circuit board 34 to which various electronic components (not physically shown) are mounted and which has input/output ("I/O") ports 36–44 for receiving and providing electrical signals to other components of sound-generating circuit 22. As illustrated in FIG. 3, I/O port 36 receives signals from input 23*a* of circuit 22 and, thus, is in electrical communication with contact/clapper 16*a*. Similarly, I/O port 38 receives signals from inputs 23*b–g* of circuit 22 and, thus, is in electrical communication with contacts/chimes 16*b–g* (i.e., chimes 16*b–g* are coupled in parallel to I/O port 38 of sound-control module 24). It should be understood, however, that as few as one of contacts/chimes 16*b–g* can be coupled to port 38 of module 24. Further, module 24 can include a greater number of I/O ports such that each of contact/chimes 16*b–g* are individually coupled to module 24.

Figure 4:
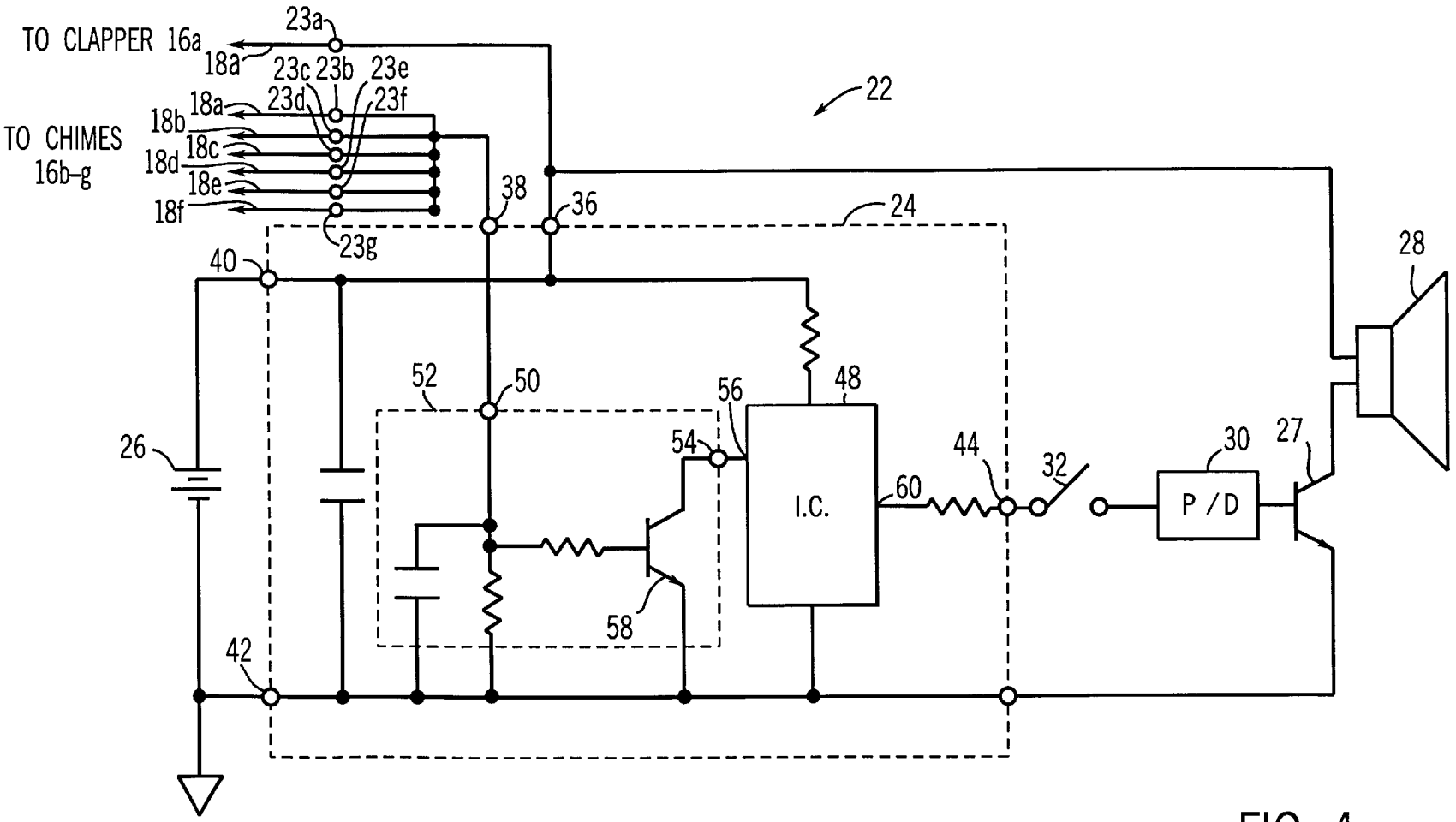
FIG. 4 is a circuit schematic of an exemplary sound-generating circuit in accordance with the invention.

Referring to FIGS. 2–4, power source 26 of sound-generating circuit 22 may be any suitable power source, such as a battery or batteries, an AC-to-DC converter which converts a conventional AC power source to a suitable low level DC voltage, a solar cell which converts solar energy to electrical power, etc. The V+ side of power source 26 is coupled to I/O port 40 of module 24 and the V− side of power source 26 is coupled to I/O port 42. Speaker 28 can be a conventional low power speaker and may be mounted to support member 12 such that the audio effect is audible to the user of apparatus 10. Speaker 28 is coupled to V+ of power source 26 and the output of amplifier 27. ON/OFF switch 32 can be a conventional toggle switch mounted to support member 12 where it is accessible to the user of apparatus 10 such that the audio effect can be selectively enabled or disabled. As illustrated in FIG. 3, switch 32 is coupled between photodetector 30 and I/O port 44 of sound-control module 24. Photodetector 30 may also be mounted to support 12 in such a manner that it can detect the presence or absence of light and can be used, for example, to disable the audio effect at nighttime. Photodetector 30 is coupled between ON/OFF switch 32 and the input of amplifier 27.

The physical connections between the various components of sound-generating circuit 22 are not illustrated in FIG. 2 for the sake of clarity of the figure. It should be understood, however, that the actual physical connections can be implemented in any number of conventional manners, such as by the use of wire harnesses, connectors, terminals, etc., as would be readily apparent to one skilled in the art.

Sound-generating circuit 22 may include other components in substitution for or in addition to the components discussed above. For example, circuit 22 can include a motion detector, and the sound-control module 24 can be configured to enable generation of the audio effect based on whether movement of an object (e.g., a person, an animal, a bird, etc.) has been detected. As another example, circuit 22 can include a selector switch which allows the user to select a mode of operation, and the sound-control circuit 24 can be configured to enable generation of the audio effect or a particular type of audio effect based on the mode selected with the selector switch. Thus, the user of apparatus 10 could use the selector switch to select either birdcalls or rainfall as the desired audio effect. Further, the selector switch could allow the user to select either a random series of birdcalls or a single birdcall. Or, the selector switch could allow the user to select the sound of waves at night and birdcalls during the day, etc. In addition, circuit 22 can include a timer circuit that prevents generation of the audio effect until a time interval has elapsed. For example, the timer circuit can cooperate with photodetector 30 to prevent generation of the audio effect until a certain time period (e.g., two hours) after daybreak has been detected.

Or, as another example, sound-generating circuit 22 can be configured to disable subsequent occurrences of the audio effect for a predetermined time interval after initiation of a previous occurrence of the audio effect. The length of the time interval preferably corresponds to the duration of a single occurrence of the audio effect to allow the audio effect to complete, without interruption, even though an air current may cause contacts 16 to repeatedly strike one another during generation of the audio effect. As a further example, sound-generating circuit 22 can be configured to impose a time delay after termination of each occurrence of the audio effect. That is, generation of subsequent occurrences of the audio effect can be disabled for a predetermined time (e.g., fifteen seconds) after a previous occurrence of the audio effect has terminated, thus preventing non-stop occurrences of audio effects.

FIG. 4 is a schematic of an exemplary embodiment of sound-generating circuit 22. In FIG. 4, clapper 16*a* and chimes 16*b–g* simply act as contacts of a multi-contact wind switch 46, with clapper 16*a* being the center pole of the switch. When the appropriate contacts 16 of wind switch 46 strike one another, an electrically conductive path for an electrical signal is provided. The electrical signal activates an integrated circuit 48 of sound control module 24 which is configured or programmed to produce an audio effect in response thereto.

Power is provided to sound control module 24 by power source 26 (e.g., two 1.5 V batteries). The positive side of the power source (V+) is coupled to contact/clapper 16*a* via conductor 18*a*. Contacts/chimes 16*b–g* are coupled in parallel to an input 50 of a pulse circuit 52. An output 54 of pulse circuit 52 is coupled to an input 56 of integrated circuit 48. When contact/clapper 16*a* strikes any of contacts/chimes 16*b–g*, a momentary electrically conductive path is created and the V+ potential is applied to input 50 of pulse circuit 52. Pulse circuit 52 includes a transistor 58 which is momentarily turned ON upon application of the V+ potential, thus providing a LOW level pulse at input 56 of integrated circuit 48. The LOW level pulse activates integrated circuit 48, which is configured to generate an audio effect at an output 60. The audio effect is amplified by amplifier 27 (coupled to output 60 via ON/OFF switch 32 and photodetector 30) and is audible through speaker 28.

It should be understood that FIG. 4 illustrates just one exemplary embodiment of sound-generating circuit 22. In alternative embodiments, circuit 22 can be configured to provide alternative and/or additional features. For example, circuit 22 can be configured such that contacts/chimes 16*b–g* are coupled to a plurality of corresponding inputs of circuit 22 (i.e., are not coupled in parallel to a single input of circuit 22). With such a configuration, sound control module 24 can be configured to generate a plurality of different audio effects, each audio effect corresponding to contact between chime 16*a* and one of chimes 16*b–g*. Thus, for example, contact between chimes 16*a* and 16*b* may cause the sound control module 24 to produce a first type of birdcall, contact between chimes 16*a* and 16*c* may cause module 24 to produce a second type of bird call, etc.

Referring now to FIG. 5, another exemplary embodiment of apparatus 10 is illustrated in which support member 12 is a housing configured as a bird feeder having a base from which contacts/chimes 16 are suspended. In this embodiment, sound-generating circuit 22 may be disposed within the birdfeeder. Thus, it is contemplated that support member 22 may be configured as any number of different objects. Further, sound-generating circuit 24 may be configured to generate an audio effect that is associated with the appearance of support member 12. As just one example, contacts/chimes 16 can be suspended from a scarecrow-like support and sound-generating circuit 22 can produce an owl call.

It should be understood that the foregoing description is of preferred exemplary embodiments of this invention, and that the invention is not limited to the specific forms shown. Further modifications may be made in the design, arrangement and combination of the elements without departing from the scope of the invention as expressed in the appended claims.

What is claimed is:

1. A wind-activated audio-generating assembly, comprising:

a support member;

a wind switch including a first electrically conductive contact suspended from the support member and a second electrically conductive contact suspended from the support member such that, when the wind switch is subjected to an air current, the first and second electrically conductive contacts strike one another; and a sound-generating circuit in electrical communication with the first and second electrically conductive contacts wherein, when the first and second electrically conductive contacts strike one another, an electrical path is established therebetween and the sound-generating circuit generates an electronic audio effect in response thereto, wherein the audio effect is at least one bird call.

2. The wind-activated audio-generating assembly as recited in claim 1, wherein the first and second electrically conductive contacts are suspended from the support member by first and second electrical conductors, respectively.

3. The wind-activated audio-generating assembly as recited in claim 2, wherein the first and second electrically conductive contacts are first and second chimes.

4. The wind-activated audio-generating assembly as recited in claim 3, wherein the first chime is a chime tube and the second chime is a clapper.

5. The wind-activated audio-generating assembly as recited in claim 1, wherein the sound-generating circuit selectively controls generation of the audio effect.

6. The wind-activated audio-generating assembly as recited in claim 5, wherein the sound-generating circuit selectively controls the generation of the audio effect based on occurrence of a predetermined condition.

7. The wind-activated audio-generating assembly as recited in claim 6, wherein the predetermined condition is detection of daylight.

8. The wind-activated audio-generating assembly as recited in claim 1, wherein the audio effect is a plurality of different types of sounds.

9. The wind-activated audio-generating assembly as recited in claim 8, further comprising a third electrically conductive contact suspended from the support member, wherein the sound-generating circuit generates a first type of sound when the first and second contacts strike one another and a second type of sound when the first and third contacts strike one another.

10. A wind chime assembly, comprising:

a housing;

a sound-generating circuit supported by the housing;

a plurality of chime members suspended from the housing, the plurality of chime members including a first chime member having a first electrically conductive portion and a second chime member having a second electrically conductive portion, the first and second electrically conductive portions arranged to randomly contact one another when the first and second chime members are subjected to an air current;

a first electrical conductor electrically coupling the first conductive portion to the sound-generating circuit; and a second electrical conductor electrically coupling the second conductive portion to the sound-generating circuit, wherein the sound-generating circuit is configured to generate an electronic audio effect when the first and second electrically conductive portions of the first and second chime members contact one another, wherein the audio effect is at least one bird call.

11. The wind chime assembly as recited in claim 10, wherein the first chime member is a clapper and the second chime member is a chime tube.

12. The wind chime assembly as recited in claim 10, wherein the sound-generating circuit includes a control circuit configured to control generation of the audio effect based on occurrence of a predetermined condition.

13. The wind chime assembly as recited in claim 12, wherein the control circuit prevents the generation of the audio effect until after occurrence of the predetermined condition.

14. The wind chime assembly as recited in claim 13, wherein the predetermined condition is elapse of a time interval.

15. The wind chime assembly as recited in claim 12, wherein the predetermined condition is detection of presence and/or absence of daylight.

16. The wind chime assembly as recited in claim 15, wherein the audio effect includes a first sound and a second sound, and the control circuit prevents generation of the first sound if the presence of daylight is detected and prevents generation of the second sound if the absence of daylight is detected.

17. An audio-generating wind chime assembly, comprising:

a housing;

a plurality of chime tubes suspended from the housing, at least one of the chime tubes being electrically conductive;

a clapper suspended from the housing and arranged to randomly strike the plurality of chime tubes when the chime tubes and the clapper are subjected to an air current, the clapper being electrically conductive;

a sound-generating circuit disposed within the housing and having a first input and a second input;

a first electrical conductor electrically coupling the electrically conductive chime tube to the first input; and a second electrical conductor electrically coupling the clapper to the second input, wherein, when the clapper strikes the electrically conductive chime tube, an electrical path is established between the first and second inputs of the sound-generating circuit, and the sound-generating circuit generates an electronic audio effect in response thereto, wherein the electronic audio effect is at least one bird call.

18. The audio-generating wind chime assembly as recited in claim 17, wherein the sound-generating circuit includes a control circuit configured to selectively control generation of the audio effect.

19. The audio-generating wind chime assembly as recited in claim 18, wherein the control circuit selectively controls the generation of the audio effect based on occurrence of a predetermined condition.

20. The audio-generating wind chime assembly as recited in claim 17, wherein the housing is configured as a bird feeder.

* * * * *